US005622131A

United States Patent [19]

Walker

[11] Patent Number: 5,622,131

[45] Date of Patent: Apr. 22, 1997

[54] COMPACT SELF-TRIMMING WINGSAIL

[76] Inventor: John G. Walker, Tipwell House, St Mellion, Cornwall, Great Britain, PL12 6RS

[21] Appl. No.: 608,044

[22] Filed: Feb. 28, 1996

Related U.S. Application Data

[63] Continuation of Ser. No. 256,761, filed as PCT/GB93/00186, Jan. 28, 1993 published as WO93/15951 Aug. 19, 1993, abandoned.

[30] Foreign Application Priority Data

Feb. 8, 1992 [GB] United Kingdom ..... 9202703

[51] Int. Cl.[6] ..... B63H 5/06

[52] U.S. Cl. ..... 114/102; 114/103

[58] Field of Search ..... 114/102, 103, 114/91

[56] References Cited

U.S. PATENT DOCUMENTS

| | | | |
|---|---|---|---|
| 3,707,935 | 1/1973 | Rachie | 114/102 X |
| 4,473,023 | 9/1984 | Walker | 114/102 X |
| 4,543,899 | 10/1985 | Walker | 114/102 X |
| 5,211,123 | 5/1993 | Greenwood | 114/91 X |

FOREIGN PATENT DOCUMENTS

| | | | |
|---|---|---|---|
| 0405701 | 11/1924 | Germany . | |
| 0028793 | 2/1988 | Japan | 114/103 |
| 0198649 | 5/1924 | United Kingdom . | |
| 8301427 | 4/1983 | WIPO . | |
| 8604035 | 7/1986 | WIPO . | |

*Primary Examiner*—Sherman Basinger
*Attorney, Agent, or Firm*—Iandiorio & Teska

[57] ABSTRACT

A wingsail assembly in which at least one thrust wing is mounted for free rotation about an upright axis and defining by its free rotation a trimming circle. The assembly includes a first control airfoil freely pivoted on a first boom extended upstream of a thrust wing, the first boom being of a length such that the first auxiliary control airfoil is within the trimming circle and a second control airfoil mounted downstream of the first control airfoil within the trimming circle and settable for controlling the angle of attack of the first control airfoil to the wind which in turn provides a turning moment for controlling the angle of attack of the thrust wing to provide thrust levels required for all normal sailing conditions. The assembly further moves the thrust wing to bring the instantaneous center of pressure of the thrust wing at different angles of attack into closer proximity to the upright axis and reduces the turning moment required of the first control airfoil, and in which the first control airfoil is freely pivoted about an axis ahead of all combined center of pressure locations for the first and second control airfoils.

12 Claims, 2 Drawing Sheets

COMPACT SELF-TRIMMING WINGSAIL

Figure 2:
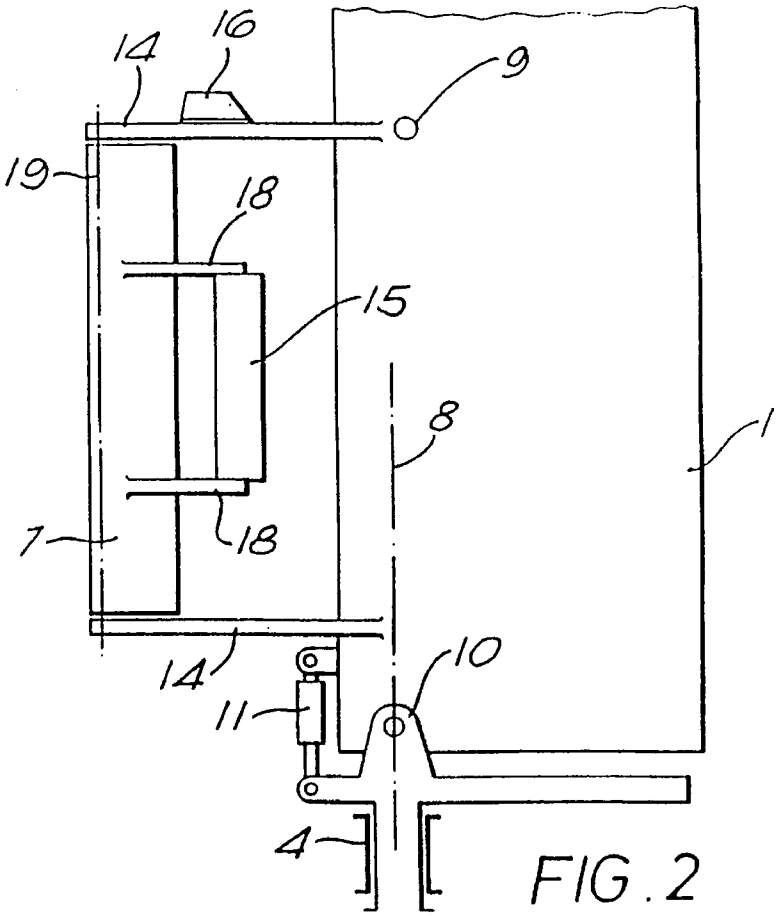

This is a continuation of application Ser. No. 08/256,761, filed as PCT/GB93/00186, Jan. 28, 1993 and now abandoned.

FIELD OF THE INVENTION

This invention relates to wingsails and especially to self-trimming wingsails.

BACKGROUND OF THE INVENTION

A wingsail is an assembly including one or more aerofoil sections, usually rigid, that is mounted span upright to propel a vessel. European patent specifications 61291, 96554 and 328254 corresponding to U.S. Pat. Nos. 4,467,741, 4,563,970 and 4,856,449 describe various aspects of wingsails, including self-trimming wingsails, of a general type to which the present invention has particular relevance. In such a self-trimming wingsail the angle of attack of a main thrust wing or wings about an upright axis is controlled by an auxiliary control aerofoil or vane, called a tail vane, mounted on a boom extending downwind from the thrust wing. Success with designs incorporating upwind auxiliary control aerofoils has not so far been achieved.

With the prior art self-trimming arrangements incorporating a tail vane, the wingsail assembly has a substantial overall trimming circle which is acceptable on craft with a wide beam, such as multi-hull sailing vessels or on ships where wingsails are used as auxiliary power, when the trimming circle will remain within the plan area of the craft, but on narrower single hulled craft the trimming circle might overhang the gunwales, which is not very practical. One aspect of the present invention is therefore directed towards providing a self-trimming rig with a more compact trimming circle.

Another problem that can arise with self-trimming wingsails is that the movement of the centre of pressure of the main thrust wing as the angle of attack changes, or as the relative deflection of the wing elements are changed, changes the effective turning moment about the main axis of the thrust wing. If the centre of pressure of the main thrust wing is too far from the main axis the compensatory trimming moment required from the auxiliary vane is greater, which in turn leads to a requirement for a larger auxiliary vane and more powerful associated deflection control mechanisms, or to a longer boom and therefore a larger trimming circle. Other aspects of the invention are directed towards controlling the position of the centre of pressure with respect to the main thrust wing axis, and to techniques for minimising the power requirements for auxiliary vane movement.

SUMMARY OF THE INVENTION

Accordingly the invention provides a wingsail assembly comprising at least one thrust wing mounted for free rotation about an upright axis, and including means for rotating and/or translating at least a portion of the thrust wing upstream or downstream so as to adjust the location of the instantaneous centre of pressure of the thrust wing with respect to the upright axis.

The invention preferably also comprises an auxiliary vane upwind of the thrust wing and arranged to trim the thrust wing about the axis, in which the auxiliary vane is freely pivoted upwind of its centre of pressure and the angle of attack of the auxiliary vane is controlled by the position of a secondary control aerofoil positioned downwind from the auxiliary vane.

A further aspect of the invention provides a wingsail assembly comprising a thrust wing freely rotatable about an upright axis and an auxiliary vane upwind of the thrust wing and arranged to trim the thrust wing about the axis, in which the auxiliary vane is freely pivoted upwind of its centre of pressure and the angle of attack of the auxiliary vane is controlled by the position of a secondary control aerofoil positioned downwind from the auxiliary vane.

DISCLOSURE OF PREFERRED EMBODIMENT

Figure 1:
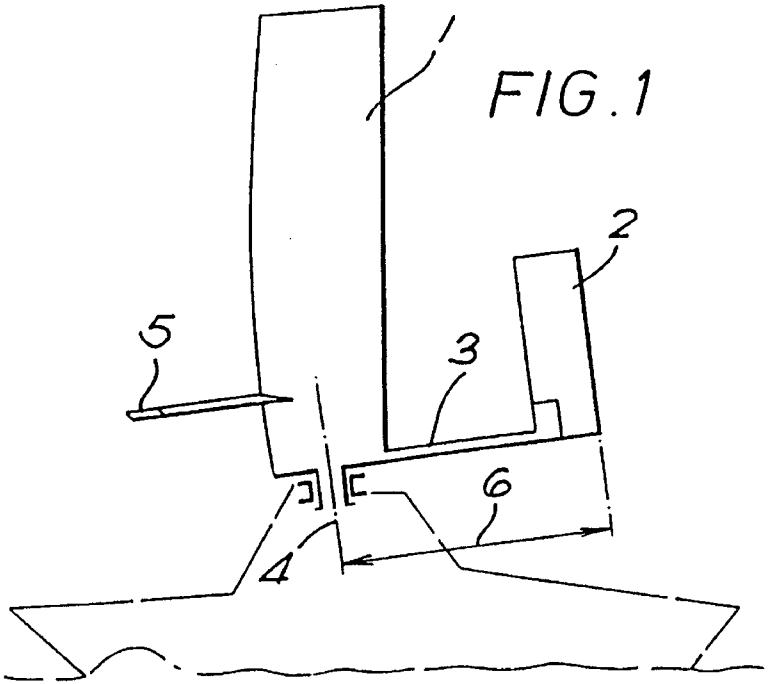
Figure 3:
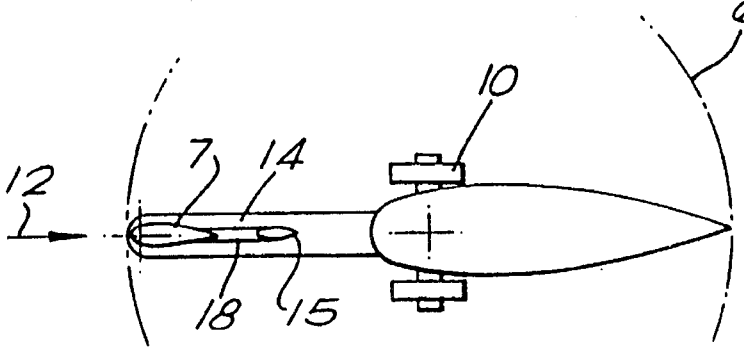
Figure 5:
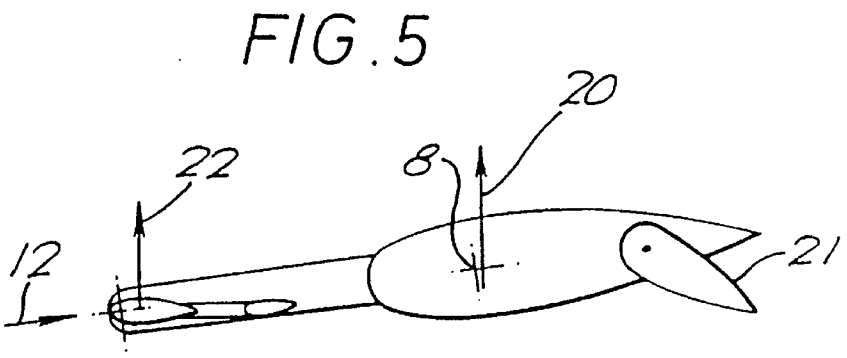
Figure 6:
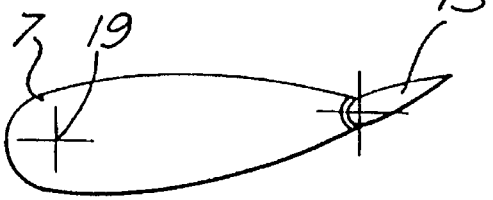
Figure 4:
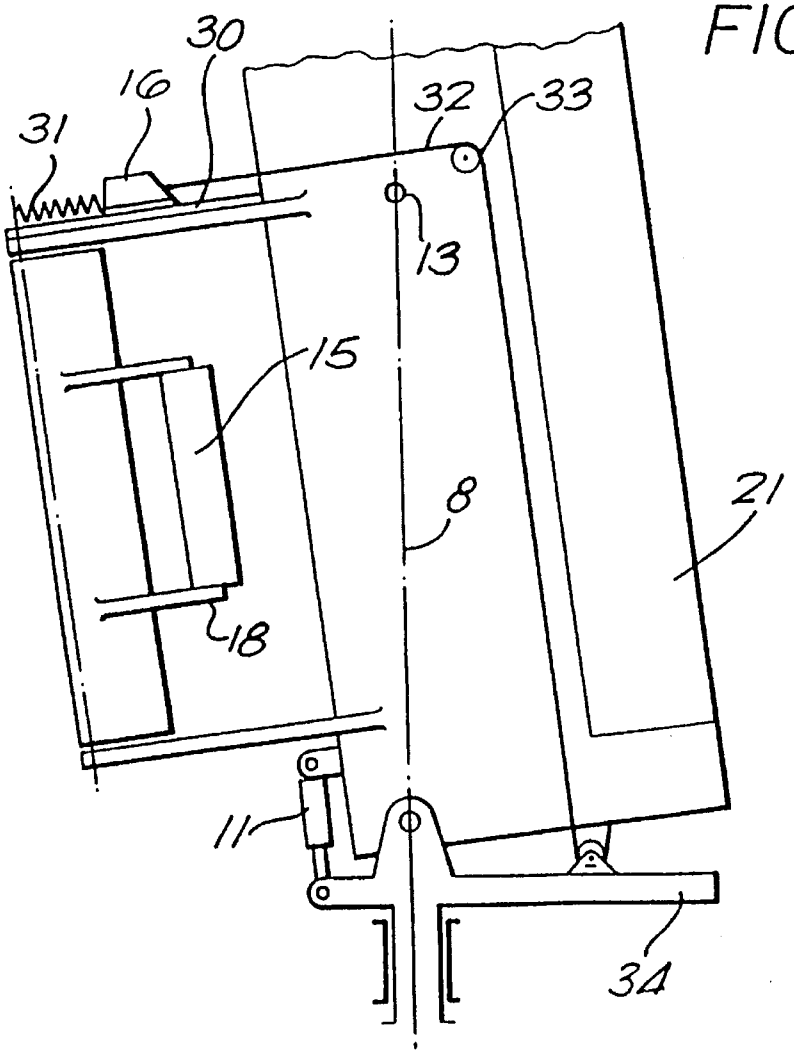

The invention is now described by way of example with reference to the accompanying drawings in which:

FIG. 1 schematically illustrates a vessel carrying a wingsail with a tail vane;

FIG. 2 schematically illustrates a wingsail thrust wing having a tilting mechanism and with an upwind control vane and secondary control vane;

FIG. 3 schematically illustrates a plan view of the wingsail of FIG. 2;

FIG. 4 schematically illustrates the wingsail of FIG. 2 tilted;

FIG. 5 illustrates in plan view the wingsail of FIG. 4 with aerofoils deflected for thrusting; and FIG. 6 schematically illustrates an alternative secondary control vane mounting.

Referring firstly to FIG. 1, a self-trimming wingsail is shown on a vessel. The wingsail comprises a thrust wing 1, which may be a single-plane or multi-plane, and each plane may be simple or may comprise a leading element and trailing element that can be pivoted to deflected positions as described for example in European Patent Specifications 61291, 96554 and 328254 corresponding to U.S. Pat. Nos. 4,467,741, 4,563,970 and 4,856,449. A tail vane 2 is mounted on a boom 3 extending from the thrust wing. The complete wingsail assembly is freely rotatable about a main bearing axis 4. A countermass 5 is provided to mass balance the wingsail about the main axis. In operation, deflection of the tail vane to a particular angle with respect to the wind provides a turning force, acting over the length of the boom 3, to rotate the wingsail about the main axis 4 to a trimmed angle of attack. The arrangement shown has a trimming circle of radius indicated by line 6. A trimmed angle of attack configuration may be defined as one in which the moment of the main thrust wing about the axis 4 is balanced by an equal and opposite moment provided by the auxiliary vane, in this case a tail vane.

It is preferable in all wingsails to provide for a requirement for zero crosswind force. Also, position of the centre of pressure of the thrust wing is not constant, for example when a leading and trailing element thrust wing is aligned with the elements coplanar the centre of pressure may be in the region of approximately 25% to 26% along the chord, but moves to a location about 34% to 35% along the chord when one element is deflected with respect to the other. With a tail vane it is usually possible to locate the main pivot axis in a position that is sufficiently close to both the centre of pressure with one element deflected with respect to the other and the centre of pressure when the elements are coplanar. It is however preferable to provide some means of compensating for the shift in the thrust wing centre of pressure, and the present invention provides this.

It is therefore proposed in one aspect of the present invention to enable movement of the thrust wing relative to the main axis. In this way a relatively constant location of the centre of pressure with respect to the main axis can be achieved, thereby minimising changes in moment and reducing the auxiliary vane moment required to trim.

FIG. 2 illustrates a preferred embodiment of the invention in which a compound thrust wing 1 is provided with an upstream auxiliary vane 7. It will be seen from the plan illustration in FIG. 3 that the trimming circle 6 is now reduced to a radius substantially equal to the length of the thrust wing downwind of the main axis: of course it is not necessary for the upwind and downwind projections of the assembly from the main bearing to be equal, but this is a convenient practical arrangement.

As shown in FIG. 2 the thrust wing 1 includes a substantially horizontal pivot at the base, this pivot enabling the thrust wing to be pivoted in the upwind and downwind sense, thereby moving the centre of pressure of the thrust wing with respect to the bearing axis. Upwind is in an anticlockwise direction as viewed in the drawing. The pivoting movement may be controlled by a linear actuator such as a hydraulic cylinder and piston 11 mounted between the thrust wing and main bearing. In the location shown in FIG. 2, contraction of the actuator produces upstream tilting: clearly it would be possible to provide an actuator downstream of the main axis operating in the opposite sense. Other means such as an electric actuator may replace the hydraulic cylinder.

FIG. 4 illustrates the configuration adopted when the wingsail is in a thrusting mode. In this thrusting position, especially when the wing has a trailing element, the centre of pressure moves downstream to a location 13 on the thrust wing. Actuator 11 is contracted and the thrust wing is tilted upstream as illustrated, so that the span of the thrust wing is inclined with respect to the main axis 8, bringing the centre of pressure to close proximity with the main axis.

In a possible modification the tilting process can be continued further in order to reduce the elevation of the wingsail for example for passing under bridges or to ease assembly or dismantling.

Instead of pivoting movement, the upstream/downstream movement of the thrust wing may be provided or augmented by translation, for example by using sliding ways.

The facility to bring the centre of pressure of the thrust wing into close proximity with the main axis at all thrusting configurations means that the size of the trimming auxiliary vane and/or length of boom can be reduced compared with the requirements in the absence of the facility where the maximum values of the thrust wing moment could be excessive. This is of significance both for power requirements for rotating the auxiliary vane and also for compactness of wingsail design, particularly for reduction of trimming circle, in both tail vane and upwind vane designs.

It will be realised that the moment arm in an upwind control vane configuration is generally less than the moment arm of a tail vane. In order to compensate for the reduced moment arm length the size of the auxiliary vane may be increased, although this results in an increased power requirement to rotate the vane.

The power requirements are minimized in the invention by providing the pivoting or sliding arrangement so that the thrust wing centre of pressure can be maintained close to the main axis.

A secondary control aerofoil 15, shown in FIGS. 3 and 4, which trims the auxiliary vane, is used to enable the main control vane to be freely pivoted ahead of its centre of pressure. The secondary control aerofoil is mounted as a tail vane to the auxiliary vane 7.

In the preferred arrangement the auxiliary vane 7 has a symmetrical aerofoil section and is freely pivoted on a spanwise axis 19 between booms 14. One boom also preferably supports a balance mass 16. The secondary control aerofoil 15 is also of symmetrical aerofoil section and is mounted downstream of the auxiliary vane 7 for example by means of its own secondary booms 18 as shown in FIGS. 2 and 4 or by mounting at the trailing edge of the vane 7 as shown in FIG. 6. A control linkage (not shown) enables the helmsman or an automatic control system to deflect the secondary aerofoil 15 to left or right of wind. When it is desired to permit the wingsail to weathercock, the secondary aerofoil 15 is set coplanar with the auxiliary vane 7, which then weathercocks freely, pivoting at zero crosswind force about its spanwise axis 19, which is positioned upstream of any possible centre of pressure of the combined auxiliary vane and secondary control aerofoil. The actuator 11 is adjusted so that the main axis passes upstream of the centre of pressure of the thrust wing and therefore the thrust wing weathercocks about the main bearing.

FIGS. 4 and 5 show the aerofoil configurations required to thrust right of wind. The secondary control aerofoil 15 is deflected right of wind and holds the auxiliary vane 7 at an angle of attack to the airflow so that its thrust, indicated by arrow 22, is sufficient to balance the moment of the thrust wing force 20 about the main axis 8. In order to keep the centre of pressure of the thrust wing close to the axis 8, the actuator 11 has been retracted to tilt the thrust wing upstream as previously described. In the event that the thrust wing has a flap or flaps 21 (which is not necessarily the case) these will be deflected left of wind for thrust right of wind. The control force required is only that needed to adjust the secondary aerofoil 15, and the required auxiliary vane moment is minimised by the tilting (or translation) of the thrust wing.

If it is required to return to zero crosswind force without centralising the flaps 21, this may be achieved by returning the secondary aerofoil vane 15 to be coplanar with the auxiliary vane 7. The thrust force 20 will tend to rotate the wingsail towards an angle of zero crosswind force. To minimise downwind drag, the actuator 11 should be extended to return the thrust wing to the upright position and any flaps 21 should be realigned with respect to the leading element of the thrust wing.

For thrust left of wind, the process is repeated in mirror image with the thrust wing again being tilted upstream but this time the secondary control aerofoil 15 being deflected left of wind and the flaps right of wind. In both thrusting configurations the wingsail remains freely rotatable about its main axis.

When the wing is tilted, the mass balancing conditions will change. To compensate for this the balance mass 16 is mounted so that it can move downwind as the thrust wing moves upwind, and vice versa, the movement of the mass being controlled proportionately to the movement of the thrust wing. A schematic arrangement permitting this movement is shown in FIG. 4, in which the balance mass 16 is connected to the main trunnion frame of the bearing. More specifically, the mass 16 slides in a track 30 and is biased to the upwind end of the boom 14 by a spring 31 and is connected to the base of the thrust wing by a line 32 passing over a sheave 33 within the thrust wing and then fixed via a second sheave on an arm 34 projecting downwind from the main trunnion frame. The upstream tilting of the thrust wing results in the mass being pulled downwind against the bias of spring 31 by the inextensible line 32, the geometrical arrangement providing that, on rotation, the moment change of the mass 16 about the free upright axis 8 is equal and opposite, or broadly equal and opposite, to the moment change of the complete wingsail, apart from mass 16, about the axis 8. Other means may be used, provided that they satisfy this requirement.

Various modifications are envisaged, for example in which the thrust wing comprises a plurality of planes or in which a plurality of auxiliary vanes and/or secondary control aerofoils may be used. Also, instead of coplanar auxiliary and control aerofoil arrangements the aerofoils may be offset so that the aerofoils have parallel, but not coplanar, axes of symmetry, for example the pivot axis of the secondary aerofoil 15 need not be in the plane of symmetry of the auxiliary vane.

I claim:

1. A wingsail assembly comprising:

at least one thrust wing mounted for free rotation about an upright axis and defining by its free rotation a trimming circle;

a first control airfoil freely pivoted on a first boom extending upstream of said thrust wing, the first boom being of a length such that the first control airfoil is within said trimming circle;

a second control airfoil mounted downstream of the first control airfoil within said trimming circle and settable for controlling the angle of attack of the first control airfoil to the wind which in turn provides a turning moment for controlling the angle of attack of the thrust wing in all propulsive configurations; and means for moving the thrust wing to bring the instantaneous center of pressure of the thrust wing at different angles of attack into closer proximity to said upright axis and reduce the turning moment required of the first control airfoil, and in which the first control airfoil is freely pivoted about an axis ahead of all combined center of pressure locations for the first and second control airfoils.

2. The wingsail assembly according to claim 1 in which the thrust wing is pivoted at its base about a substantially horizontal axis to enable the leading edge of the thrust wing to be pivoted at least one of upwind and downwind.

3. The wingsail assembly according to claim 1 further comprising a balance mass provided with means for moving the mass downstream as the thrust wing is moved upstream.

4. The wingsail assembly according to claim 1 in which the second control airfoil is mounted on at least one boom extending downwind from the control airfoil.

5. The wingsail assembly according to claim 1 in which the second control airfoil is mounted at the trailing edge of the first control airfoil.

6. In the wingsail assembly of the type comprising an upright thrust wing mounted freely for rotation about an upright axis and a control airfoil providing a turning moment for controlling the angle of attack of the thrust wing to the wind, the improvement comprising reducing the circle described by the wingsail assembly as it rotates to a trimming circle of a radius substantially equal to the maximum length of the thrust wing downwind of the upright axis by:

a) mounting the control airfoil upwind of the thrust wing on at least one boom lying within the trimming circle;

b) minimizing the turning moment for trimming the thrust wing by providing means for moving the thrust wing to maintain a predetermined distance between the instantaneous center of pressure of the thrust wing and the upright axis for varying angles of attack of the thrust wing; and c) freely pivoting the control airfoil and providing a second control airfoil between the thrust wing and the control airfoil which is settable to control the angle of attack of the control airfoil in all propulsive configurations.

7. The wingsail assembly according to claim 6 in which the thrust wing is pivoted at its base about a substantially horizontal axis to enable the leading edge of the thrust wing to be pivoted forwardly.

8. The wingsail assembly according to claim 6 further comprising a balance mass provided with means for moving the mass downstream as the thrust wing is moved upstream.

9. The wingsail assembly according to claim 6 in which the second control airfoil is mounted on a boom extending down wind from the control airfoil.

10. The wingsail assembly according to claim 6 in which the second control airfoil is mounted at the trailing edge of the control airfoil.

11. A wingsail assembly comprising:

at least one thrust wing mounted for free rotation about an upright axis; and a control airfoil assembly comprising a first control airfoil mounted on a boom extending upstream of said thrust wing and freely pivoted about a second upright axis, and a second control airfoil mounted downstream of the first control airfoil, between the first control airfoil and the thrust wing; said first control airfoil being settable by said second control airfoil to provide a turning moment for said thrust wing in all propulsive configurations and said control airfoil assembly being settable to weathercock about said second upright axis for zero thrust.

12. A wingsail assembly comprising:

at least one thrust wing mounted for free rotation about an upright axis and defining by its free rotation a trimming circle;

a control airfoil assembly comprising a first control airfoil mounted on a boom extending upstream of said thrust wing and freely pivoted about a second upright axis, and a second control airfoil mounted downstream of the first control airfoil, between the first control airfoil and the thrust wing; and said first control airfoil being settable by said second control airfoil to exert a turning moment on said thrust wing in all propulsive configurations, said control airfoil assembly being settable to weathercock about said second upright axis for zero thrust and said boom being of a length such that the control airfoil assembly lies within said trimming circle.

* * * * *